United States Patent [19]

McKay

[11] Patent Number: 4,693,224

[45] Date of Patent: Sep. 15, 1987

[54] FUEL INJECTION METHOD AND APPARATUS

[75] Inventor: Michael L. McKay, Willeton, Australia

[73] Assignee: Orbital Engine Company Proprietary Limited, Balcatta, Australia

[21] Appl. No.: 740,067

[22] PCT Filed: Aug. 3, 1984

[86] PCT No.: PCT/AU84/00150

§ 371 Date: Apr. 2, 1985

§ 102(e) Date: Apr. 2, 1985

[87] PCT Pub. No.: WO85/00854

PCT Pub. Date: Feb. 28, 1985

[30] Foreign Application Priority Data

Aug. 5, 1983 [AU] Australia ..... PG0718/83

[51] Int. Cl.[4] ..... F02M 67/02

[52] U.S. Cl. ..... 123/531; 123/457; 123/458

[58] Field of Search ..... 123/531, 532, 533, 534, 123/535, 445, 457, 458

[56] References Cited

U.S. PATENT DOCUMENTS

| | | | |
|---|---|---|---|
| 432,260 | 7/1890 | Brayton | 123/47 R |
| 1,079,578 | 11/1913 | Peterson | 123/533 |
| 1,551,731 | 9/1925 | Charter | 123/531 |
| 1,788,703 | 1/1931 | Bushnell . | |
| 2,127,165 | 8/1938 | Ehrat | 123/531 |
| 2,280,317 | 4/1942 | Stehle et al. | 123/532 |
| 4,462,760 | 7/1984 | Sarich et al. | 417/54 |
| 4,554,945 | 11/1985 | McKay | 137/312 |
| 4,556,037 | 12/1985 | Wisdom | 123/531 |
| 4,561,405 | 12/1985 | Simmons | 123/531 |

FOREIGN PATENT DOCUMENTS

| | | | |
|---|---|---|---|
| 0063262 | 11/1969 | Australia . | |
| EP83514 | 7/1983 | European Pat. Off. | 123/531 |
| 663887 | 8/1939 | Fed. Rep. of Germany . | |
| 0833736 | 3/1952 | Fed. Rep. of Germany . | |
| 0163455 | 5/1921 | United Kingdom . | |
| 184836 | 8/1922 | United Kingdom . | |
| 270460 | 5/1927 | United Kingdom . | |
| 332286 | 7/1930 | United Kingdom . | |

*Primary Examiner*—Willis R. Wolfe, Jr.

*Attorney, Agent, or Firm*—Murray and Whisenhunt

[57] ABSTRACT

Method and apparatus for fuel injection to an internal combustion engine is disclosed. Gas is supplied to a fuel holding chamber to maintain a reference pressure which is above atmospheric pressure in the fuel holding chamber. A metered quantity of fuel is delivered into the holding chamber against the reference pressure. Communication is established between the holding chamber and the engine, and the supply of gas to the holding chamber is maintained while the communication exists so the pressure of the gas is sufficient to displace the metered quantity of fuel from the holding chamber to the engine.

23 Claims, 4 Drawing Figures

FUEL INJECTION METHOD AND APPARATUS

This invention is directed to the injection of fuel into the combustion chamber of an internal combustion engine and is particularly applicable to engines which operate at a high cycling rate.

For convenience of explanation within this specification, the invention is particularly described in relation to spark ignition 2-stroke cycle reciprocating engines. However, the invention is also applicable to compression ignition engines and to four stroke cycle engines, rotary engines and engines with circular oscillating pistons, e.g. that described in U.S. Pat. No. 4,037,997.

There is an increasing requirement for less expensive and more efficient fuel injection systems for internal combustion engines. In-cylinder injection has distinct and well-known advantages in comparison with manifold injection and throttle-body injection carburettors. However with existing apparatus there are large cost penalties relating to the high degree of precision engineering required in the manufacture of hardware for in-cylinder injection systems.

A further disadvantage arising in in-cylinder fuel injection is the constraint on the timing and duration of the injection of fuel into the working chamber. This is aggravated by the increasingly high speeds of revolution of modern engines. The use of modern materials and construction techniques has made 6,000 rpm not uncommon for mass produced engines. At this speed, in a four-stroke cycle engine, the time interval for injection of fuel to the working chamber is of the order of 6 to 9 ms.

Despite their many advantages, 2-stroke cycle engines are today restricted from many applications for two major reasons, excessive hydrocarbon emissions and excessive fuel consumption. Both problems arise primarily from the scavenging process for the working chamber in these engines which allows part of the incoming fuel air charge to escape directly through the exhaust system prior to combustion, and also allows excessive dilution of the incoming charge under throttled conditions, thereby inducing misfiring. It is known that such problems can be greatly reduced by the use of in-cylinder fuel injection of such an engine, and this is discussed in the introductory passages to U.S. Pat. No. 3,888,214. In-cylinder fuel injection also offers greater opportunity to achieve a stratified charge in the working chamber which can give improved combustion effects.

However, the efficient performance of such an engine is to a large degree dictated by the performance of its fuel injection system. In comparison with the requirements regarding the short time interval available for injection discussed above for 4-stroke cycle engines, an in-cylinder fuel injection system for a 2-stroke cycle engine requires an even better performance. In a piston ported, crankcase scavenged, reciprocating 2-stroke cycle engine running at only 6,000 rpm a desired time interval for injection is a mere 2–3 ms. If any fuel is injected outside this time interval the engine's efficiency suffers considerably. If injection commences too early there can be considerable loss of unburnt fuel through the still open exhaust port and, if continued too late, the fuel can be injected into already burning mixture with undesirable combustion consequences.

Conventional in-cylinder fuel injection systems have previously required a high pressure fuel pump and high differential pressure metering apparatus. Also the efficiency of in-cylinder fuel injection is dependent on fine atomization of the fuel at the point of delivery. Both these requirements result in a high cost in componentry due to the high standards of engineering required in production due to the close tolerances on manufacturing dimensions.

The use of pneumatic fuel metering is described in SAE Technical Paper 820351 by McKay, and although the method described therein achieves exceptionally fine fuel atomization on delivery, and is eminently suited to multi-point injection to the inlet manifold of internal combustion engines, some difficulty can be encountered in applying the system directly to in-cylinder injection, particularly where the injection window is less than 10 ms.

A number of attempts have been made to fuel 2-stroke engines using in-cylinder injection and to achieve a desired stratified charge by other means. However, as far as is known all have encountered a considerable drop in engine performance at high speeds in comparison with equivalent carburettor fuelled engines.

One attempt, (S.A.E. Technical Paper 780767 by Vicilledent) used a Bosch EFI (Electronic Fuel Injection) manifold injector modified to give the required metering and response characteristics. It was fed with fuel at elevated pressure and used an air skirt (apparently for cooling) directed around the pintle of the injector. This arrangement would have produced a mean fuel droplet diameter greater than 200 micrometers which, while satisfactory for atomization for manifold injection, is unsatisfactory for in-cylinder injection, so engine performance would have been greatly limited at high speeds. Also, the engine could not achieve acceptable operation at high speed and this was probably due to the injection system's inability to keep within the optimum injection time interval.

Attempts by others have involved the use of various diesel injectors for in-cylinder injection of petrol. These are commonly utilized for experimental injection of petrol into spark-ignition engines but require a high fuel delivery pressure to open the valve incorporated in the nozzle of diesel type injectors. Fuel is usually delivered to the injectors at up to 14,000 kPa and the atomization achieved can give a mean droplet size down to about 25 micrometers.

Although the degree of atomization is good, this arrangement requires a precision manufactured high pressure fuel pump, and an injection nozzle manufactured to very close tolerances, in order to accurately meter the petrol under such a high pressure drop. In addition to the high cost of hardware, it appears that these experiments have produced engines which have lost considerable performance at high speed, again probably because the required amount of fuel could not be injected within the necessary small time interval, at a sufficient level of atomisation to allow adequate vaporization prior to combustion.

Also it has been argued that in previous proposals for in-cylinder fuel injection the high pressure of the fuel system has been justified as a means to prevent fuel vaporisation. Metering has previously been performed at the point of introduction of the fuel to the working chamber of the engine, where high temperatures are experienced, and hence any vaporisation of the fuel would seriously affect metering accuracy. Thus in such fuel injection systems a high pressure fuel system is essential, and so the disadvantages flowing from the high pressure system must be tolerated.

Thus the main inadequacies of prior proposed in cylinder fuel injection systems are the high cost of manufacture, the unsatisfactory fuel droplet size produced, and the inability to inject the required fuel within the required time interval to efficiently fuel engines operating at high speeds.

It is therefore the principal object of the present invention to provide a method and apparatus for fuel metering and injection that is suitable for direct in-cylinder injection, which is effective in operation, economic to manufacture and achieves and maintains acceptable atomization of the fuel.

With this object in view there is provided according to the present invention a method of injecting fuel to an engine combustion chamber comprising controlling the supply of a gas to a fuel holding chamber to maintain a reference pressure that is above atmospheric pressure and above the pressure existing in the engine combustion chamber during injection of fuel thereto from the holding chamber;

delivering a metered quantity of fuel into the holding chamber against said reference pressure;

establishing communication between the holding chamber and the combustion chamber; and maintaining said supply of gas to the holding chamber while said communication exists so the pressure of the gas is sufficient to displace the metered quantity of fuel from the holding chamber to the combustion chamber.

Conveniently the metering of the fuel may be carried out prior to or during delivery to the holding chamber.

Preferably the communication between the holding chamber and the engine combustion chamber is established by selectively opening a valve to permit the fuel to be delivered to the combustion chamber.

It will be appreciated that this method of fuel delivery to an engine separates in time the fuel metering function from the fuel injection function. As a result only the fuel injection function is required to be performed in the strict time constraint previously discussed. The fuel metering function may be performed at any time and over any period within the engine cycle but preferably not during the relatively short injection period.

In view of the relatively long period of time available in which to prepare the metered quantity of fuel and deliver it to the holding chamber improved accuracy in metering can be achieved. Further, as the holding chamber is maintained throughout the metering and injection cycle at a pressure sufficient to effect injection of the fuel to the combustion chamber, there is no time delay in establishing the required pressure each injection cycle.

A further advantage of the present method is that the metering function may be performed physically distanced from the point of injection to the combustion chamber, and hence in a lower temperature environment. Accordingly, the possibility of vapourization of the fuel is reduced with its attendant adverse effect on metering accuracy. This further permits lower fuel handling pressures to be employed.

The invention will be more readily understood from the following examples of practical arrangements of the metering and injecting fuel as illustrated in the accompanying drawings.

In the drawings

Figure 1:
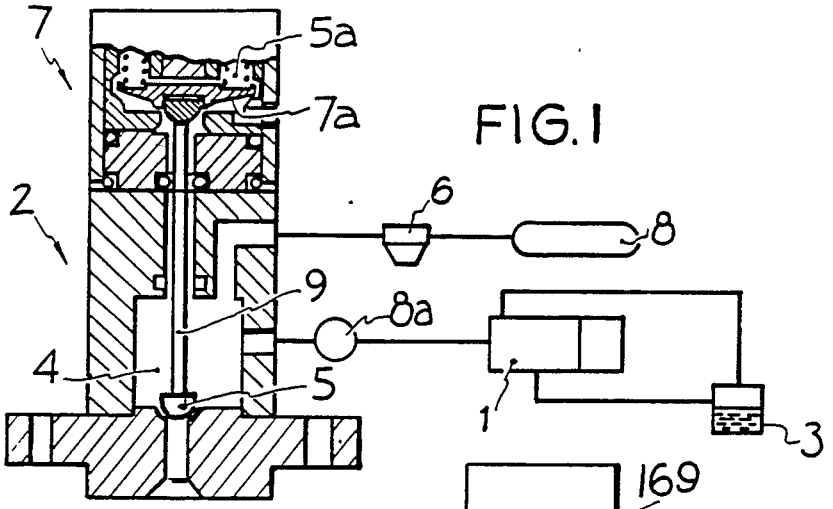
FIG. 1 is a diagramatic representation of the method of the present invention.

The method of the present invention as represented diagramatically in FIG. 1 basically involves the use of a fuel metering device 1, a holding chamber device 2, a fuel supply 3, a pressure gas supply 8 and pressure control devices 6 to regulate the pressure of the gas, such as air, into the holding chamber device 2.

The fuel metering device 1 may be any one of a variety of such devices currently used for metering fuel to an engine, including devices for metering fuel into the induction manifold or the working chamber of an internal combustion engine. The fuel metering devices may measure the quantity of fuel to be injected prior to delivery to the holding chamber device 2, or during delivery to the holding chamber device.

The holding chamber 4 receives air from the supply 8 via the pressure control device 6 so that a substantially steady reference pressure is maintained in the holding chamber. The value of the reference pressure is discussed hereinafter.

Although the reference pressure is preferably steady, in practice some fluctuation will occur throughout each cycle. Upon opening of the valve in the holding chamber to effect injection of the fuel there will be some drop in pressure, and during the delivery of the fuel to the holding chamber there will be a slight rise in pressure not withstanding these fluctuations the reference pressure is considered to be steady.

The metered volume of fuel is fed into holding chamber 4, against the reference pressure during which the nozzle valve 5 remains closed due to its being loaded into the closed position by the spring 5*a* acting on the armature 7*a* of the solenoid 7, the armature 7*a* being connected by the rod 9 to the valve 5. When the amount of fuel required for delivery during the forthcoming cycle of the engine has been delivered to holding chamber 4, solenoid 7 is energised to open nozzle valve 5.

The check valve 8*a* prevents fluid flow back into metering device 1, the reference pressure is maintained in the holding chamber 4. Upon opening of the nozzle valve 5 the metered quantity of fuel held in chamber 4 is propelled by the air through nozzle valve 5 into the working chamber of the engine. The delivery opening of the nozzle valve 5 is appropriately shaped to achieve required fuel spray characteristic in the working chamber. Upon de-energising the solenoid 7 the nozzle valve 5 is again closed in preparation for the next delivery of a metered quantity of fuel.

The reference pressure of the air in the holding chamber is selected so that it is sufficiently above the pressure in the engine working chamber, at the time of fuel delivery, that all of the measured quantity of fuel is delivered into the working chamber within the permissible time interval, having regard to the engine speed. This time interval is normally up to about 10 ms in a four-stroke cycle engine and may be as low as about 2 ms in a two-stroke cycle engine.

The air reference pressure is preferably about 500 kPa above atmospheric. It will be appreciated that the reference pressure must be above atmospheric and above the cylinder pressure at the time of injection of the fuel into the combustion chamber and a pressure of 100 kPa above cylinder pressure is preferred, although successful operation has been achieved using only 50 kPa difference.

A fuel supply pressure, to the metering device, as low as 0.2 kPa above reference has been successfully used in operating an engine with this form of fuel injection system. However, this fuel supply pressure may be as high as necessary or found convenient but is preferably less than 1000 kPa above the reference pressure and more specifically less than 700 kPa. Most preferred is about 400 kPa.

The timing of the energizing of the solenoid 7 in relation to the engine cycle may be controlled by a suitable sensing device activated by a rotating component of the engine such as the crankshaft or flywheel or any other component driven at a speed directly related to engine speed. A sensor suitable for this purpose is an optical switch including an infra-red source and a photo detector with Schmitt trigger.

In order to avoid costs, the duration of energization of the solenoid is preferably not variable, and is fixed in accordance with the duration suitable for the maximum operating speed of the engine.

In a modification to the arrangement shown in FIG. 1 the valve 5 is not connected to or actuated by the solenoid 7, but is in the form of a pressure actuated check valve that will open in response to the pressure in the chamber 4 reaching a predetermined value. This pressure would be of the same order as the reference pressure referred to in respect to the embodiment shown in FIG. 1.

In this modification the pressure in the chamber 4 is normally atmospheric or at least below the pressure that will open the check valve. The metered quantity of fuel is delivered into the chamber while this low pressure exists, and when injection is required gas is admitted to the chamber 4 at a pressure sufficient to open the check valve and inject the metered quantity of fuel into the engine combustion chamber.

The metering of the quantity of fuel to be delivered into the holding chamber in the embodiment shown in FIG. 1 may be by the metering apparatus disclosed in U.S. Pat. No. 4,554,945 briefly described with reference to FIGS. 2 and 3 of the accompanying drawings.

The metering apparatus comprises a body 110, having incorporated therein four individual metering units 111 arranged in side by side parallel relationship. This unit is thus suitable for use with a four cylinder engine. The nipples 112 and 113 are adapted for connection to a fuel supply line and a fuel return line respectively, and communicates with respective fuel supply and return galleries 60 and 70 provided within the block 110 for the supply and return of fuel from each of the metering units 111. Each metering unit 111 is provided with an individual fuel delivery nipple 114 to which is connected a respective holding chamber, such as 4 referred to in FIG. 1, to supply fuel to four respective cylinders of an engine.

Figure 3:
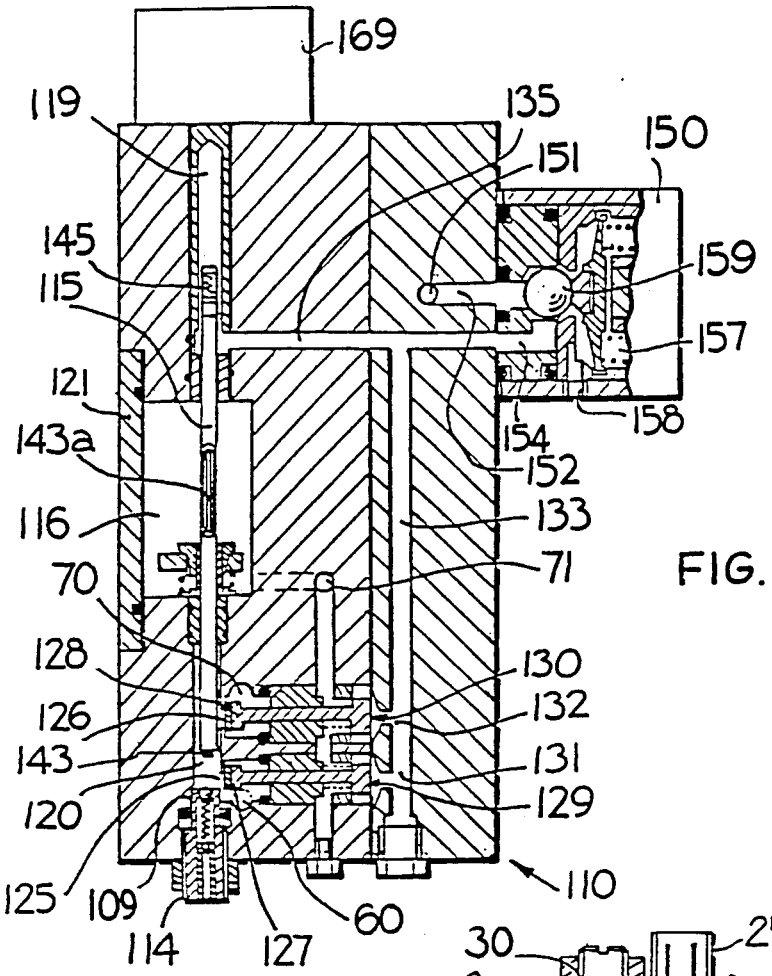
FIG. 3 is a sectional view along line 3—3 in FIG. 2.

FIG. 3 shows in section one metering unit having a metering rod 115 extending into the air supply chamber 119 and metering chamber 120. Each of the four metering rods 115 pass through the common leakage collection chamber 116 which is formed by a cavity provided in the body 110 and the coverplate 121 attached in sealed relation to the body 110. The function and operation of the leakage collection chamber is no part of this invention and is described in greater detail in U.S. Pat. No. 4,554,945.

Each metering rod 115 is hollow, and is axially slidable in the body 110, and the extent of projection of the metering rod into the metering chamber 120 may be varied to adjust the quantity of fuel displaceable from the metering chamber. The valve 143 at that end of the metering rod located in the metering chamber 120, is supported by the rod **143*a* extending through the hollow metering rod. The valve 143 is normally held closed by the spring 145, located between the upper end of the hollow rod 115 and valve rod 143*a*, to prevent the flow of air through the hollow bore of the metering rod 115 from the air supply chamber 119 to the metering chamber 120. Upon the pressure in the chamber 119 rising to a predetermined value the valve 143 is opened so air will flow from chamber 119 to the metering chamber through hollow rod 115, and thus displace the fuel from the metering chamber 120. The quantity of fuel displaced by the air is that fuel located in the chamber 120 between the point of entry of the air to the chamber, and the point of discharge of the fuel from the chamber, that is the quantity of fuel between the air admission valve 143 and the delivery valve 109 at the opposite end of the metering chamber 120**.

Each of the metering rods 115 are coupled to the crosshead 161, and the crosshead is coupled to the actuator rod 160 which is slidably supported in the body 110. The actuator rod 160 is coupled to the motor 169, which is controlled in response to the engine fuel demand, to adjust the extent of projection of the metering rods into the metering chambers 120, and hence the position of the air admission valve 143 so the metered quantity of fuel delivered by the admission of the air is in accordance with the fuel demand. The motor 169 may be a reversible linear type stepper motor such as the 92100 Series marketed by Airpak Corp.

The fuel delivery valves 109 are each pressure actuated to open in response to the pressure in the metering chamber 120, when the air is admitted thereto from the air supply chamber 119. Upon the air entering the metering chamber through the valve 143 the delivery valve 109 also opens and the air will move towards the delivery valve displacing the fuel from the metering chamber through the delivery valve. The valve 143 is maintained open until sufficient air has been supplied to displace the fuel between the valves 143 and 109 from the chamber into a holding chamber such as 4 in FIG. 1.

Each metering chamber 120 has a respective fuel inlet port 125 and a fuel outlet port 126 controlled by respective valves 127 and 128 to permit circulation of fuel from the inlet gallery 60 through the chamber 120 to the outlet gallery 70. Each of the valves 127 and 128 are connected to the respective diaphragms 129 and 130. The valves 127 and 128 are spring-loaded to an open position, and are closed in response to the application of air under pressure to the respective diaphragms 129 and 130 via the diaphragm cavities 131 and 132. Each of the diaphragm cavities are in constant communication with the air conduit 133, and the conduit 133 is also in constant communication with the air supply chamber 119 by the conduit 135. Thus, when air under pressure is admitted to the air supply chamber 119 and hence to the metering chamber 120 to effect delivery of fuel, the air also acts on the diaphragms 129 and 130 to cause the valves 127 and 128 to close the fuel inlet and outlet ports 125 and 126.

The control of the supply of air to the chamber 119 through conduit 135, and to the diaphragm cavities 131 and 132 through conduit 133, is regulated in time relation with the cycling of the engine through the solenoid operated valve 150. The common air supply conduit 151 connected to a compressed air supply via nipple 153, runs through the body 110 with respective branches 152 providing air to the solenoid valve 150 of each metering unit.

Normally the spherical valve element 159 is positioned by the springs 157 to prevent the flow of air from conduit 151 to conduit 135 and to vent conduit 135 to atmosphere via vent port 158. When the solenoid is energised the force of the springs 157 is released from the valve element 159, and the valve element is displaced by the pressure of the air supply to permit air to flow from conduit 151 to conduit 135 and 133.

The above described solenoid operated air supply control valve may also be used to control the supply of air to the metering chamber 4, in the previously described modified form of the holding chamber shown in FIG. 1, wherein a pressure actuated check valve opens in response to the establishment of a predetermined pressure in the chamber.

The operation of the solenoid valve 150 may be controlled to vary the duration of the period that air is supplied to the air chamber 119 and cavities 131 and 132, to ensure the fuel displaced from the metering chamber is delivered to the holding chamber. Also the operation of the solenoid valve 150 is timed with reference to the engine cycle to ensure a charge of fuel is in the holding chamber when the nozzle valve such as valve 5 in FIG. 1 is opened for injection of fuel to the engine working chamber.

The admission of the air to the metering chamber may be controlled by an electronic processor, activated by signals from the engine that sense the fuel demand of the engine. The processor may be programmed to vary the frequency and duration of admission of the air to the metering chamber. Further details of the operation of such a control can be obtained from U.S. Pat. No. 4,561,405.

Figure 4:
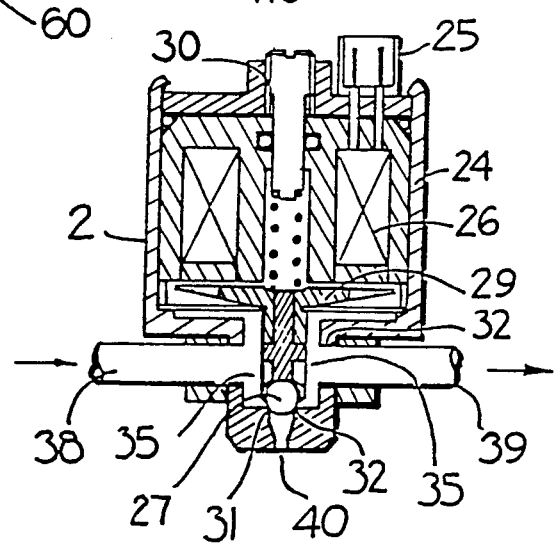
FIG. 4 is a sectional view of an alternative form of metering device for use in the present invention.

An alternative form of fuel metering device is shown in FIG. 4 comprising a body 24 housing a solenoid 26 connected to a terminal 25. The valve element 27 is connected to the armature plate 29 of the solenoid. The spring 30, reacting against the armature plate 29, normally holds the valve element 27 against the valve seat 31 to close the port 32.

The fuel cavity 35 communicates with the port 32 and is adapted for connection to respective fuel supply and fuel return lines 38 and 39. A continuous supply of fuel is circulated through the cavity 35 at a pressure above the reference pressure in the holding chamber such as chamber 4 in FIG. 1.

Upon energising of the solenoid 26 the valve element 27 is raised to open the port 32 and thereby permit fuel to flow from the cavity 35 through the orifice 40 into the holding chamber. The orifice 40 is calibrated with respect to the pressure drop from the fuel supply to the reference pressure in the holding chamber. Accordingly, by controlling the length of time that the port 32 is open the quantity of fuel delivered to the holding tank is metered.

Figure 2:
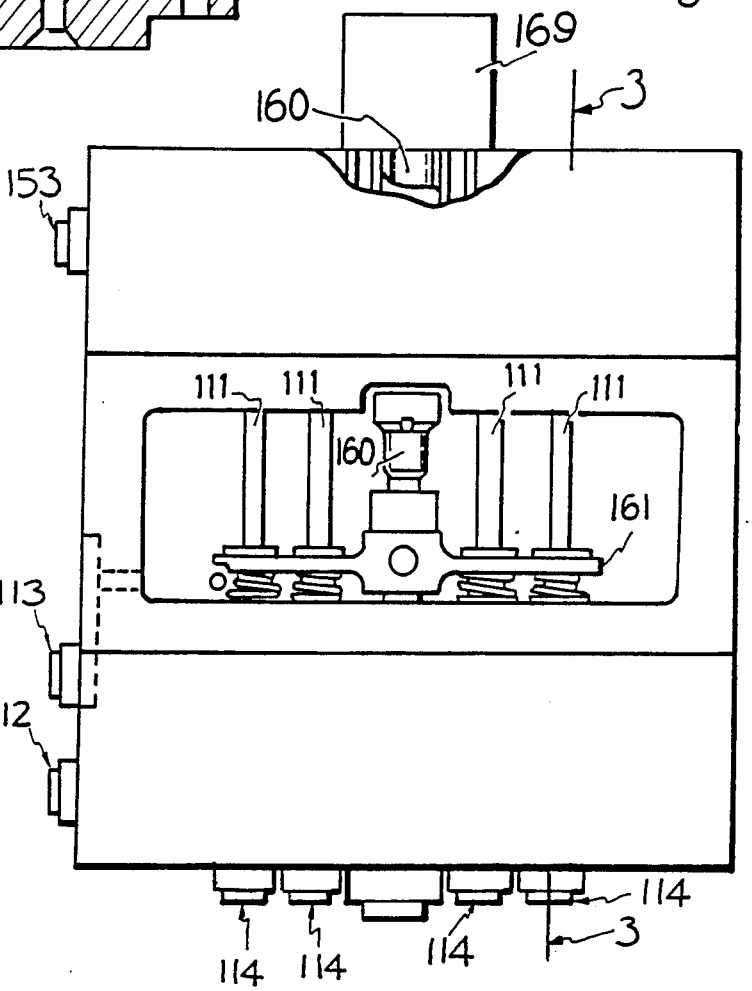
FIG. 2 is an elevation of a metering unit for use in the present invention.

As previously described with reference to FIGS. 2 and 3 the period that the solenoid is energised and the timing thereof in relation to the engine cycle may be controlled by an electronic processor activated by signals from the engine that sense the fuel demand of the engine.

As an alternative to energising the solenoid at a steady voltage for a period determined by the engine load, the voltage may be pulsed. The fuel is thus delivered as a plurality of fixed duration pulses of fuel, and the total quantity of fuel is varied by varying the number of pulses.

Other types of fuel metering devices may be employed in carrying out the present invention provided they can effectively deliver the fuel into the holding chamber against the reference pressure maintained therein.

I claim:

1. A method of injecting fuel into a spark ignited internal combustion engine comprising:

controlling the supply of a gas to a fuel holding chamber to maintain a reference pressure that is above atmospheric pressure;

delivering fuel to the holding chamber against said reference pressure and regulating the period of and pressure differential effecting the delivery of the fuel to control the quantity of fuel delivered in accordance with the engine fuel demand;

establishing communication between the holding chamber and the engine after the delivery of the fuel to the holding chamber; and maintaining said supply of gas to the holding chamber while said communication exists so the pressure of the gas is sufficient to displace the fuel from the holding chamber into the engine.

2. A method of injecting fuel into a spark ignited internal combustion engine comprising:

controlling the supply of gas to a fuel holding chamber to maintain a reference pressure that is above atmospheric pressure, delivering fuel to the holding chamber against said reference pressure and metering the fuel during delivery to regulate the quantity of fuel delivered in accordance with the engine fuel demand, establishing communication between the holding chamber and the engine after the delivery of the fuel to the holding chamber; and supplying gas to the holding chamber while said communication exists so the pressure in the holding chamber is sufficient to displace the metered quantity of fuel from the holding chamber into the engine.

3. Apparatus for injection of fuel to a spark ignited internal combustion engine having a combustion chamber comprising;

a holding chamber; means adapted for connecting said holding chamber to a pressurised gas source to admit gas from said source to the holding chamber and in opertion maintain a reference pressure in the holding chamber that is above atmospheric pressure;

fuel metering means operable to deliver a metered quantity of fuel in accordance with the engine fuel demand to said holding chamber against said reference pressure and including means for controlling the period of and pressure effecting delivery of the fuel to the holding chamber to determine the metered quantity of fuel; and selectively openable valve means in said holding chamber operable to establish communication between the holding chamber and the engine combustion chamber after delivery of the metered quantity of fuel to the holding chamber;

whereby the metered quantity of fuel held in the holding chamber is delivered to the combustion chamber by the gas pressure in the holding chamber when said injection valve means is open.

4. A method of injecting fuel into a spark ignited two stroke cycle internal combustion engine, said method comprising;

controlling the supply of gas to a fuel holding chamber to maintain a reference pressure therein that is above atmospheric pressure, delivering fuel into said holding chamber against said reference pressure, controlling the quantity of fuel delivered to the holding chamber in accordance with the engine fuel demand, establishing communication between the holding chamber and the engine after delivery of the fuel to the holding chamber to permit delivery of the fuel from the holding chamber to the engine; and maintaining in the holding chamber during communication thereof with the engine a pressure sufficient to displace the fuel from the holding chamber into the engine.

5. Apparatus for injection of fuel to a spark ignited internal combustion engine having a combustion chamber comprising;

means adapted for connection to a pressurised gas source to admit gas from said source to a holding chamber and in operation maintain a reference pressure in the holding chamber that is above atmospheric pressure;

fuel metering means operable to deliver a metered quantity of fuel in accordance with the engine fuel demand to said holding chamber against said reference pressure and including means for metering the quantity of fuel during delivery to the holding chamber;

selectively openable valve means in said holding chamber operable to control communication between the holding chamber and the engine combustion chamber;

whereby the metered quantity of fuel held in the holding chamber is delivered to the combustion chamber by the gas pressure in the holding chamber when said valve means is open.

6. Apparatus as claimed in claim 5, wherein the fuel metering means include a selectively operable fuel valve through which the fuel is delivered to the holding chamber; and means to regulate the time interval that the fuel valve is open to thereby control the quantity of fuel delivered to the holding chamber.

7. Apparatus for injection of fuel to a spark ignited internal combustion engine having a combustion chamber comprising;

means adapted for connection to a pressurised gas source and operable to selectively admit gas from said source to a holding chamber and in operation maintain a reference pressure in the holding chamber that is above atmospheric pressure;

fuel metering means operable to deliver a metered quantity of fuel in accordance with the engine fuel demand to said holding chamber against said reference pressure and including means for measuring the metered quantity of fuel prior to delivery to the holding chamber; and means for selectively applying gas pressure to the metered quantity of fuel to deliver it into the holding chamber against the reference pressure existing therein;

selectively openable valve means in said holding chamber operable to control communication between the holding chamber and the engine combustion chamber;

whereby the metered quantity of fuel held in the holding chamber is delivered to the combustion chamber by the gas pressure in the holding chamber when said valve means is open.

8. Apparatus as claimed in claim 7, wherein the fuel metering means includes:

a meterinc chamber;

a fuel transfer port selectively openable to communicate the metering chamber with the holding chamber;

a gas inlet port selectively openable to the metering chamber to admit gas thereto;

whereby, on admission of gas to the metering chamber and opening of said transfer port, fuel in the metering chamber is displaced therefrom by the gas to the holding chamber; and means to control the quantity of fuel displaceable from the metering chamber by the admission of the gas.

9. Apparatus for injection of fuel to a spark ignited two stroke cycle internal combustion engine having a combustion chamber comprising;

a holding chamber; means adapted for connecting said holding chamber to a pressurised gas source to admit gas from said source to the holding chamber and in operation maintain a reference pressure in the holding chamber that is above atmospheric pressure;

fuel metering means operable to deliver a metered quantity of fuel in accordance with the engine fuel demand to said holding chamber against said reference pressure;

means adapted to selectively apply gas pressure to the metered quantity of fuel to deliver it into the holding chamber against the reference pressure existing therein; and selectively openable valve means in said holding chamber operable to establish communication between the holding chamber and the engine combustion chamber after delivery of the metered quantity of fuel to the holding chamber;

whereby the metered quantity of fuel held in the holding chamber is delivered to the combustion chamber by the gas pressure in the holding chamber when said valve means is open.

10. Apparatus as claimed in claim 9, wherein the fuel metering means includes:

a metering chamber;

a fuel transfer port selectively openable to communicate the metering chamber with the holding chamber;

a gas inlet port selectively openable to the metering chamber to admit gas thereto;

whereby; on admission of gas to the metering chamber and opening of said transfer port, fuel in the metering chamber is displaced therefrom by the gas to the holding chamber; and means to control the quantity of fuel displaceable from the metering chamber by the admission of the gas.

11. Apparatus for injection of fuel to a spark ignited two stroke cycle internal combustion engine having a combustion chamber comprising;

a holding chamber; means for connecting said holding chamber to a pressurised gas source to admit gas from said source to the holding chamber and in operation maintain a reference pressure in the holding chamber that is above atmospheric pressure;

fuel metering means operable to deliver a metered quantity of fuel in accordance with the engine fuel demand to said holding chamber against said reference pressure and including means adapted to measure the metered quantity of fuel as it is delivered into the holding chamber; and selectively openable valve means in said holding chamber operable to effect communication between the holding chamber and the engine combustion chamber after the metered quantity of fuel has been delivered to the holding chamber;

whereby the metered quantity of fuel held in the holding chamber is delivered to the combustion chamber by the gas pressure in the holding chamber.

12. Apparatus as claimed in claim 11, wherein the fuel metering means includes a selectively openable fuel valve through which the fuel is delivered to the holding chamber; and means to regulate the time interval that the fuel valve is open to thereby control the quantity of fuel delivered to the holding chamber.

13. A method of injecting fuel into the combustion chamber of a spark ingnited two stroke cycle internal combustion engine, said method comprising;

controlling the supply of gas to a fuel holding chamber to maintain a reference pressure therein that is above atmospheric pressure, delivering fuel into said holding chamber against said reference pressure, controlling the quantity of fuel delivered to the holding chamber in accordance with the engine fuel demand, establishing communication between the holding chamber and the combustion chamber after delivery of the fuel to the holding chamber to permit delivery of the fuel from the holding chamber to the combustion chamber, and maintaining in the holding chamber during communication thereof with the combustion chamber a pressure sufficient to displace the fuel from the holding chamber into the combustion chamber.

14. A method of fuel injection as claimed in claim 13, wherein the metered quantity of fuel is measured prior to delivery into the holding chamber.

15. A method of fuel injection as claimed in claim 13, wherein the metered quantity of fuel is propelled into the holding chamber by a gas under pressure.

16. A method according to claim 13, wherein fuel is supplied to the holding chamber through a selectively openable fuel valve, and the metered quantity of fuel is controlled by regulating and the time interval that the fuel valve is open.

17. A method of injecting fuel into the combustion chamber of a spark ignited internal combustion engine, said method comprising:

controlling the supply of gas to a fuel holding chamber to maintain a reference pressure therein that is above atmospheric pressure, delivering fuel into said holding chamber against said reference pressure, controlling the quantity of fuel delivered to the holding chamber in accordance with the engine fuel demand, establishing communication between the holding chamber and the combustion chamber after delivery of the fuel to the holding chamber to permit delivery of the fuel from the holding chamber to the combustion chamber, and maintaining in the holding chamber during communication thereof with the combustion chamber a gas pressure sufficient to displace the fuel from the holding chamber into the combustion chamber.

18. A method of fuel injection as claimed in claim 17, wherein the metered quantity of fuel is measured prior to delivery into the holding chamber.

19. A method of fuel injection as claimed in claim 17, wherein the metered quantity of fuel is propelled into the holding chamber by a gas under pressure.

20. A method according to claim 17, wherein fuel is supplied to the holding chamber through a selectively openable fuel valve, and the metered quantity of fuel is controlled by regulating the time interval that the fuel valve is open.

21. A method as claimed in claim 17, wherein the pressure of the fuel supply is steady and a plurality of fixed duration deliveries of fuel are made through an orifice to establish said metered quantity of fuel;

and the number of said fixed duration deliveries is controlled to vary the quantity of fuel delivered to the holding chamber.

22. A method of fuel injection as claimed in claim 17, wherein the metered quantity of fuel is delivered to the holding chamber by the steps comprising;

filling a metering chamber with fuel, the metering chamber having a selectively openable transfer port communicating the metering chamber with the holding chamber; and admitting gas to said metering chamber to displace a controlled quantity of fuel from the metering chamber upon opening of the transfer port.

23. A method according to claim 22, wherein the control of the quantity of fuel displaceable from the metering chamber is effected by adjusting the relative positions of entry of the gas to and of the discharge of the fuel from said metering chamber through the transfer port, whereby the fuel capacity of the metering chamber between said positions is varied.

* * * * *